US005775028A

United States Patent [19]

Lambert

[11] Patent Number: 5,775,028

[45] Date of Patent: Jul. 7, 1998

[54] WINDOW STAYS

[76] Inventor: Peter Winston Lambert, 364 Royal Road, Massey, Auckland, New Zealand

[21] Appl. No.: 591,465

[22] PCT Filed: Jun. 28, 1994

[86] PCT No.: PCT/NL94/00066

§ 371 Date: May 2, 1996

§ 102(e) Date: May 2, 1996

[87] PCT Pub. No.: WO95/02106

PCT Pub. Date: Jan. 19, 1996

[30] Foreign Application Priority Data

| | | | |
|---|---|---|---|
| Jul. 9, 1993 | [NZ] | New Zealand | 248114 |
| Feb. 15, 1994 | [NZ] | New Zealand | 250881 |
| May 26, 1994 | [NZ] | New Zealand | 260606 |

[51] Int. Cl.[6] ..... E05D 15/28

[52] U.S. Cl. ..... 49/248; 49/251; 49/246

[58] Field of Search ..... 49/246, 247, 298, 49/251, 339, 341, 342, 345, 346

[56] References Cited

U.S. PATENT DOCUMENTS

| | | | |
|---|---|---|---|
| 2,674,452 | 4/1954 | Hummert | 49/251 X |
| 3,650,070 | 3/1972 | Ringle | 49/251 |
| 3,838,537 | 10/1974 | Stavenau et al. | 49/248 |
| 4,143,556 | 3/1979 | Hauber | 49/342 X |
| 4,617,758 | 10/1986 | Vetter | 49/342 X |
| 4,943,104 | 7/1990 | Zani et al. | 49/341 X |
| 5,452,543 | 9/1995 | VonWald et al. | 49/346 |

FOREIGN PATENT DOCUMENTS

| | | |
|---|---|---|
| 14150/88 | 10/1988 | Australia . |
| 0 364 379 | 4/1990 | European Pat. Off. . |
| 364 379 | 4/1990 | European Pat. Off. . |
| 0 419 687 | 4/1991 | European Pat. Off. . |
| 1 352 675 | 5/1974 | United Kingdom . |
| 2 202 271 | 9/1988 | United Kingdom . |
| 2 214 230 | 8/1989 | United Kingdom . |
| 2 236 798 | 4/1991 | United Kingdom . |
| 2 236 801 | 4/1991 | United Kingdom . |
| 2 258 491 | 2/1993 | United Kingdom . |
| 2 268 539 | 4/1994 | United Kingdom . |
| 87/05963 | 10/1987 | WIPO . |

*Primary Examiner*—Jerry Redman

*Attorney, Agent, or Firm*—Jacobson, Price, Holman & Stern, PLLC

[57] ABSTRACT

A window stay assembly for fitment between a window frame member and a window sash member and having two preferably elongate window stays extending directly or indirectly between the window frame member and the window sash member. Those ends pivotably mounted preferably through a mounting plate to preferably the window frame member directly or indirectly interengaged by direct or indirect gearing so that the movement of one gives rise to some predetermined proportional or identical movement of the other. The distal ends of the window stays are themselves pivotably mounted directly or indirectly to the window sash member with at least on of the pivotal mounts being through a friction slide mechanism. The arrangement enables a reproducible opening of a window from its frame using a thin window stay assembly.

4 Claims, 22 Drawing Sheets

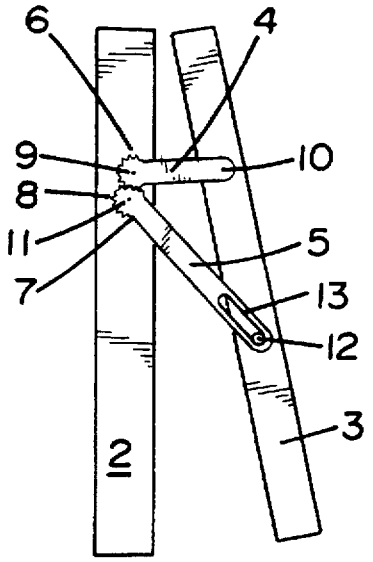
FIG. 1
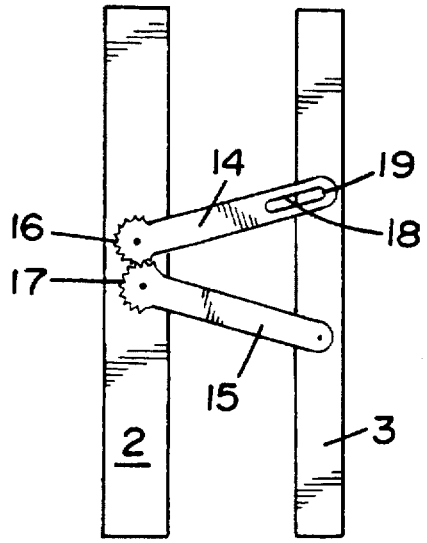
FIG. 2
FIG. 3
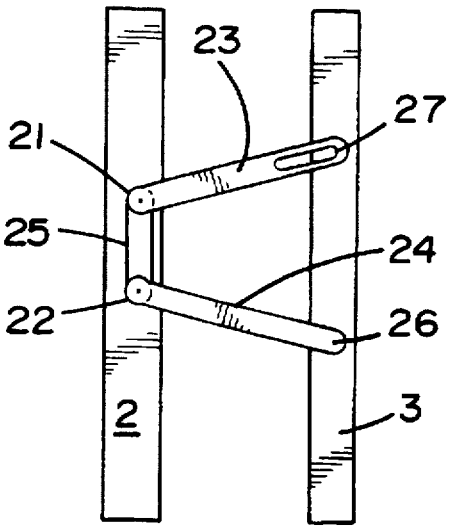

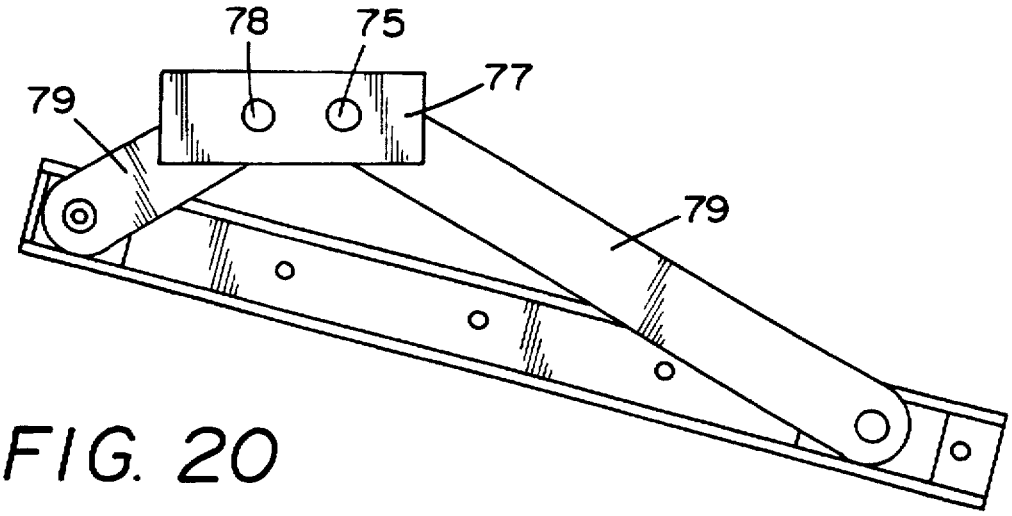
FIG. 20
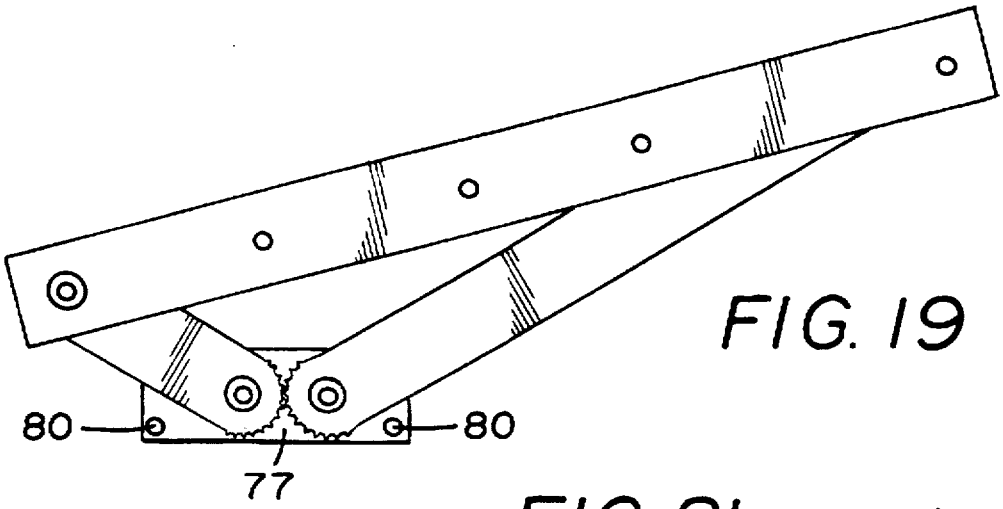
FIG. 19
FIG. 21
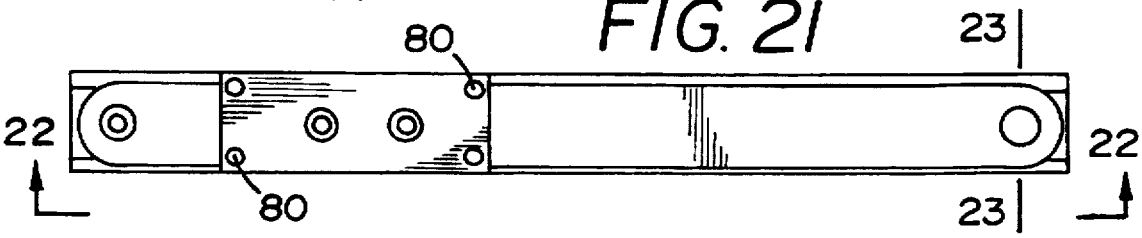
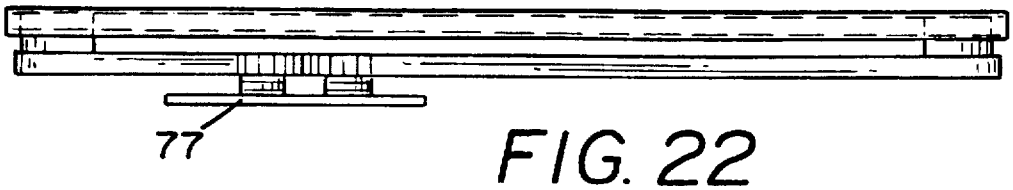
FIG. 22

WINDOW STAYS

TECHNICAL FIELD

This invention relates to window stays.

BACKGROUND ART

Conventional window stays have been developed to support a window pane and surrounding window sash from the window frame. Window stays known as friction stays allow the window to be fully supported by the stays with no other hinge connection between the window sash and window frame. The stays are rotatably mounted on both the window frame and window sash so that, upon opening the window, frictional rotation of the stays about their pivot points on the frames and sash for the window support the window in an open position. Many of these allow a gap between the window sash and frame, both below and above the window.

An alternative conventional configuration provides window stays rotatably mounted on the window frame and one stay rotatably mounted to the window sash. The second window stay is slidably mounted onto the window sash. As with the previous example, such stays generally allow the window to open outwards with the bottom edge of the window sash furthest away from the window frame but also allowing some space between the window sash at its top edge and the window frame.

U.S. Pat. No. 3,838,537 discloses a friction device slidably mountable on a window frame but having mounted therefrom interconnected arm members. Such a construction however, does not provide the prospect of a simple window stay of the type envisaged by the present invention nor one capable of being fitted in a factory or being provided as a retail pack which will nevertheless provide for a slim window stay assembly.

DISCLOSURE OF INVENTION

It is an object of this invention to provide window stays which allow alternative opening configurations to those previously known and/or at least provide the public with a useful choice.

Accordingly, in a first aspect, the invention consists in window framing apparatus comprising:

a window frame;

a window sash;

at least one pair of window stays, each stay being directly or indirectly attached to the window frame and the window sash and each pair of window stays directly or indirectly supporting a common side of said window sash from a corresponding side of said window frame; and wherein each window stay within said pair of window stays is interconnected, either directly or indirectly, with the other window stay in said pair such that rotation of one window stay in said pair will cause a proportional rotation of said other window stay in said pair without any substantial movement of the pivot axes and adjacent the direct or indirect interconnection of the window stays.

Preferably, said stays are each pivoted from a mounting member (eg a plate).

Preferably, said window stays are both each pivoted to either the window frame or the window sash directly or indirectly (eg via a mounting member) and are preferably directly interengaged adjacent such pivot axes.

Preferably, said direct interengagement comprises complementary interlocking gear teeth of each said window stays.

Preferably, said window stays are both each pivoted to its window frame or window sash and are interengaged by (i) spacer gears, (ii) a rack (linear or segmented), or (iii) an endless link selected from a belt, chain or cable which engage with teeth carried by or of each said window stay.

Preferably at least one stay is connected by a slide mechanism to its window frame or sash.

Preferably, said stays are pivoted at each end (directly or indirectly) to said window sash, at least one such pivot being to a slide mechanism.

Preferably, said slide mechanism is a friction slide mechanism.

Preferably there is an adjustable stop in said slide mechanism.

Preferably, one stay extends beyond its pivot to its window sash to a parallel pivotal connection with another window sash to control the disposition of that window sash.

Preferably, the extension of one stay is telescopic or slidably is pivoted to said another window sash.

Preferably, said two stays are substantially in the plane of the window frame when closed but extend to opposite sides of the plane of the window frame when opened.

Preferably, said two stays are substantially in the plane of the window frame when closed but extend to the same side of the plane of the window frame when opened.

In another aspect the invention consists in a window stay assembly or components thereof, which when assembled operatively in conjunction with a window frame and a window sash can provide window framing apparatus as previously defined, said assembly or components comprising a pair of window stays, each including spaced means each to define pivots whereby each means can separately be pivoted directly or indirectly to both a window frame and sash, at least one means to define a pivot of each stay including at least a plurality of teeth at least partially surrounding the means to define a pivot whereby, when mounted in use with such at least partially surrounded mean to define a pivot of each stay from the same window frame or window sash, and fixed relative thereto against any sliding of the pivots, there can be proportional rotation of one window stay with the other about their adjacent such pivotal axes as a result of (a) direct tooth interengagement, (b) interengagement via a spacing gear or plurality of gears, (c) a flexible interconnecting member engageable with said teeth as with a sprocket or the equivalent, (d) a rack (complex or otherwise) or (e) a screw threaded member.

Preferably, said apparatus also includes at least one of the components (b) through (e).

Preferably, a mounting plate has each of said stays pivoted thereto to define said means to define a pivot.

Preferably at least one of said window stays is either telescopic in its nature or has provision whereby at least one of said means for pivotal mounting to a said window frame or a said window sash is capable of being slidably mounted.

In a further aspect the present invention consists in a method of mounting a window capable of opening or closing from or into a frame comprising linking opposite sides of the sash of the window with said frame in a mirrored complementary manner by (i) a first stay pivoted directly or indirectly to each of said frame and sash with parallel pivot axes, (ii) a second stay pivoted directly or indirectly to each of said frame and sash with parallel, all such pivot axes being parallel yet spaced, and whereby a direct or indirect mechanical engagement of one stay to the other about the pivot axes of each stay at either the frame or sash provides a reproducible proportional movement one by the other (directly or indirectly) about such pivot axes to open or close the window as permitted by a telescopic extension/contraction of or a sliding mount mounting of one of said stays proximate is pivot axis not in such proportional movement causing mechanical engagement.

In another aspect consists in a window stay or equivalent mounting and/or the use thereof substantially as hereafter described with reference to the accompanying drawings.

BRIEF DESCRIPTION OF DRAWINGS

Preferred forms of the present invention will now be described with reference to the accompanying drawings in which:

FIG. 1 is an elevational view of one embodiment of window framing apparatus in accordance with the invention;

FIG. 2 is an elevational view of a second embodiment of window framing apparatus in accordance with the invention;

FIG. 3 is an elevational view of a third embodiment of window framing apparatus in accordance with the invention;

FIG. 19 is a view of apparatus as depicted in for example any one of FIGS. 7*a* through 7*d* and FIG. 6 showing how to facilitate mounting a mounting member such as a mounting plate is provided for fitment to a window frame (or in the alternative a window sash) such a mounting member preferably being in the form of a plate to which each of the stays is pivoted with its at least partially surrounding teeth directly interengaged, it being realised how such a mounting plate can in turn be fitted to the window frame and/or sash and how if desired the other embodiments previously disclosed can likewise have intervening ears etc likewise mounted from the same mounted plate.

FIG. 20 is a reversed view of the apparatus of FIG. 19,

FIG. 21 is the apparatus as depicted in FIG. 20 when in alignment,

FIG. 22 is a view BB with respect to the arrangement of FIG. 21, and

BEST MODE(S) FOR CARRYING OUR THE INVENTION

Figure 4:
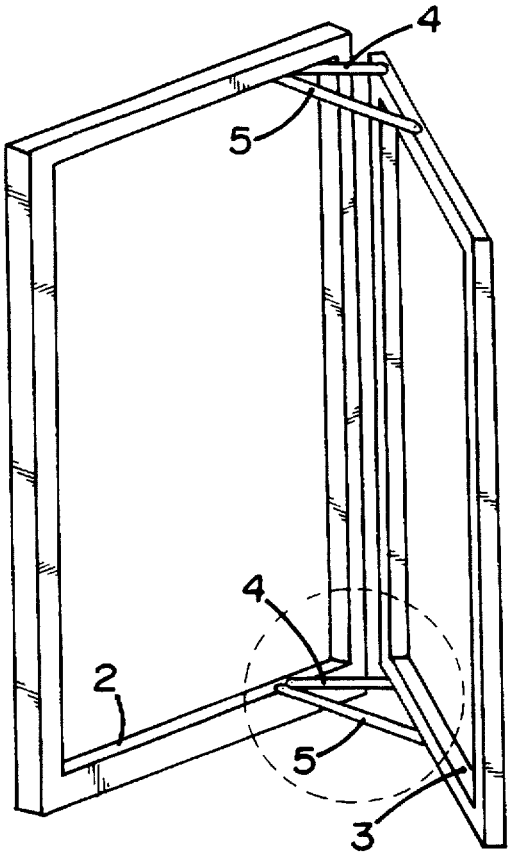
FIG. 4 shows a window frame having a swing open type window, the stay being of an interacting type as depicted in, for example, FIG. 1 or FIG. 2.

This invention concerns window framing apparatus and, in particular, although not necessarily solely, apparatus for metal, particularly aluminium, framed windows. Also it is appropriate for other materials eg. wood, plastics, UPVC and steel.

The apparatus comprises a window frame 2, a window sash 3 to surround a window pane (not shown) and a pair of window stays 4 and 5. The window stays 4 and 5, as shown in FIG. 1, are interconnected at their respective ends, 6 and 7, each pivotally and separately attached to the window frame 2. The interconnection is by means of gear teeth 8 on the perimeter of the ends of the window stays 4 and 5. These gear teeth 8 interlock such that a rotation of window stay 4 will create a proportional rotation in window stay 5. The two rotations may be in opposite directions as shown in the arrangement in FIG. 1 or the rotations may be in the same direction as shown in the arrangement in FIG. 3.

The arrangement shown in FIG. 1 provides pivot points for the window stays 4 and 5 on both the window frame 2 and the window sash 3. These pivot points are shown as numbers 9, 10, 11 and 12. These pivots should preferably be reasonably firm so that the window sash 3 is lightly restrained in an open position from reclosing against the window frame 2 as with conventional window stays.

One window stay may have a sliding connection such as slot 13 in conjunction with the rotational connection 12.

The gearing of the gear teeth 8 at the ends of the window stays 4 and 5 can be different from one stay to the other to provide a series of different opening configurations for the window. Furthermore, the length of the window stays 4 and 5 also act to change the configuration of the window when in its open position.

As shown in FIG. 2, window stays 14 and 15 may be provided with interlocking gear teeth 16 and 17 at their ends similar to the window frame apparatus shown in FIG. 1. In this example, the window stays 14 and 15 are substantially the same length and a sliding connection is provided between the window stay 14 and the window sash 3. This is provided by slot 18 in the window stay 14 which accommodates the pivot member 19. Again, varied opening configurations can be provided by changing the gear ratios on the teeth 16 and 17 and, in this example, the window framing apparatus provides a window sash which remains vertical when opened and substantially parallel with the window frame 2. Such an opening configuration would allow a good flow of air from beneath the bottom edge of the window sash through the window opening and out the gap between the top of the window sash 3 and the window frame 2.

It should be noted that the sliding joint provided on the window stay 14 may alternatively be provided on the window stay 15. It is not preferable that sliding joints be provided on both window stays as the sliding connections with the window stays are generally of lower friction and the sliding joints may not be able to support the window in its open position.

It may be possible, in some configurations, to dispense with the sliding joint on both of the stays.

As shown in FIG. 3, the interconnection between the ends 21 and 22 of window stays 23 and 24 respectively is provided by a belt or similar indirect connection 25. Alternatives to the belt 25 would include chains, links or any other known apparatus which will rotationally interrelate the two window stays 23 and 24. Again, changing of the gear ratios of both or either ends of the window stays 21 and 22 would provide varying opening configurations to the window framing apparatus.

As with the previous example, one rotational joint 26 is provided to the sash 3 and one both rotational and sliding joint 27.

These examples may be interchanged with a variety of sliding or just rotational joints to either the window frame or the window sash. Furthermore, all the examples show the interconnection between the ends of the pairs of window stays being at the window frame. As an alternative, the window stays could be reversed such that the interconnecting ends are connected to the window sash 3 and the other ends of the window stays connected to the window frame. It is, however, the preferred method to interconnect the window stays adjacent the window frame.

Thus, it can be seen that window framing apparatus is provided which offers a number of varying opening configurations depending on the gear ratios between the window stays and the exact form of their interconnection. In particular, an opening configuration which allows the window pane to move to an open configuration such that the sash is substantially parallel to the window frame is provided. Another alternative is to provide a window framing apparatus which allows the window sash to move out from the plane of the window frame and then upwards while maintaining a configuration substantially parallel to the window frame. Such an opening configuration will allow the window pane to perhaps rest against the outside of a wall incorporating the window frame 2 and above the opening of the window frame when fully opened.

A variety of different forms of the present invention will now be described with reference to the remaining drawings from which it will be noted that the window stays are of a friction or non-friction type. When the window stays are of a non-friction type it will be noted that the friction restraint can be achieved in a number of different ways ranging from the use of a friction slide mechanism or mechanisms, friction bearings, friction gear meshing, friction rack mechanisms and/or reciprocal double or single rack mechanisms.

It will also be seen that the stop (or adjustable stop) can be achieved in a number of different ways and can reply upon the slide mechanisms, the slide adjustable stop, the arm restraint points, the rack mechanisms or the double/single push mechanisms.

It can also be seen that the bar shapes i.e. the stays can have the arms straight or bent or of any other configuration.

FIG. 4 shows a window frame having a swing open type window, the stay being of an interacting type as depicted in, for example, FIG. 1 or FIG. 2.

Figure 5:
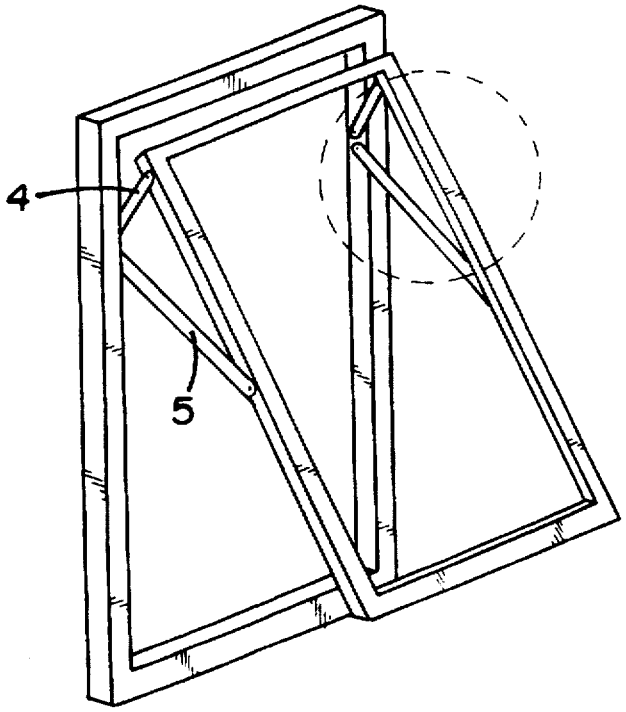
FIG. 5 is an alternative to FIG. 4 but showing a similar windows stay arrangement mounting the window to swing upwardly and outwardly.

FIG. 5 is an alternative to FIG. 4 but showing a similar window stay arrangement mounting the window to swing upwardly and outwardly.

Figure 6:
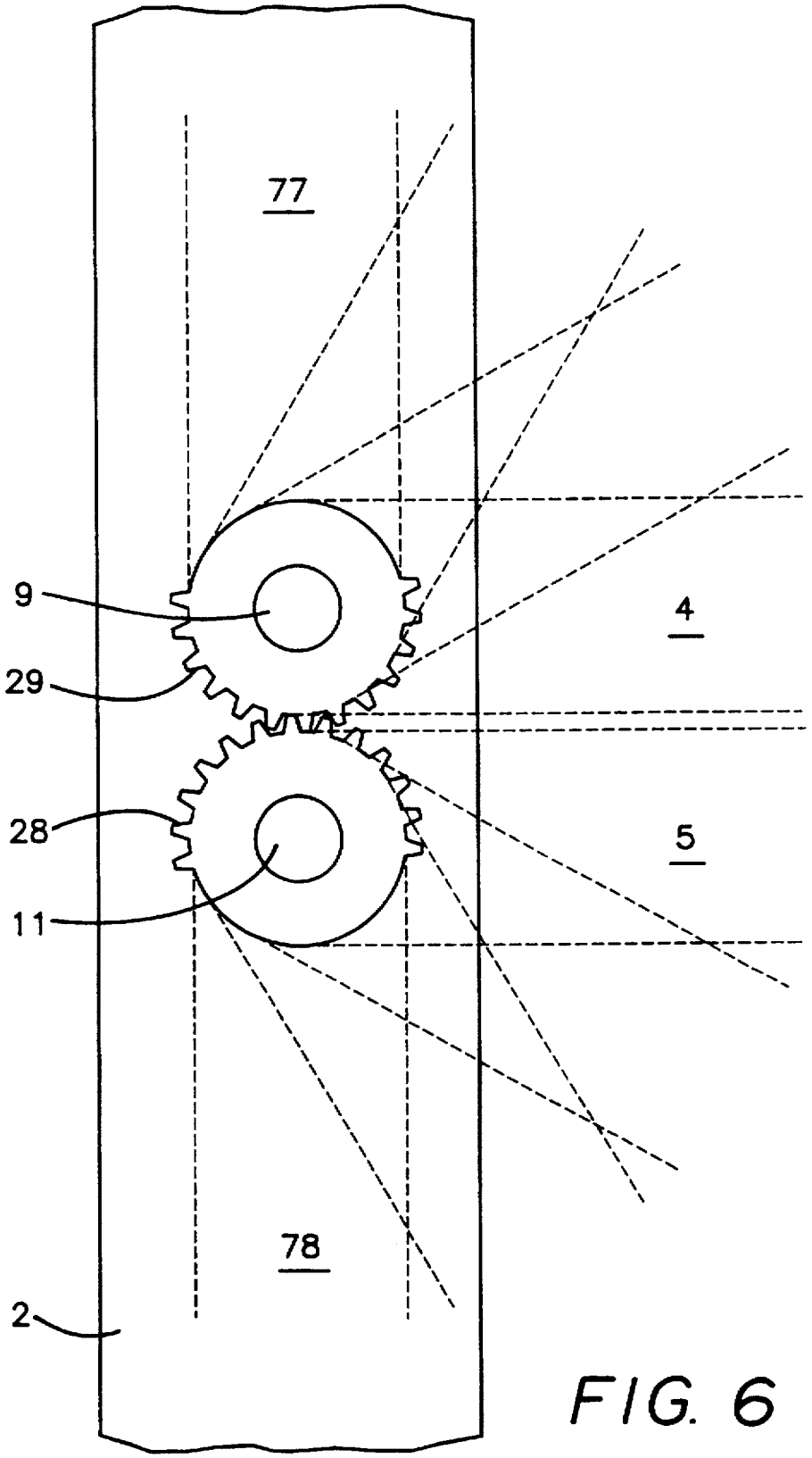
FIG. 6 is a plan view of the interaction between the bar components of window mountings as shown in FIG. 4 or FIG. 5.

FIG. 6 is a plan view of the interaction between the bar components of window mountings as shown in FIG. 4 or FIG. 5. In FIG. 4 the stay arms 4 and 5 (as in FIG. 1) are shown connecting a window frame (2) to the window sash (3). While the stay top and bottom are adapted to operate in unison in a manner as described in FIG. 1, it can be seen by reference to FIG. 4 which shows a mounting of a window from its sash in one plane, it can be mounted in a fan light or the equivalent way as shown in FIG. 5. FIG. 6 highlights the interengagement of the arms 5 and 4 shown in FIGS. 4 and 5, therebeing shown at least in part the interengaging teeth 28, 29 of arms 5 and 4 respectively, the arms 5 and 4 being pivoted to the window frame 2 at points 9 and 11 or mounted on plates which are then attached to the frame/sash.

FIG. *7a* through *7d* show a variation of the form of window stay shown in FIGS. 1 and 2 but when mounted in a configuration either as shown in FIG. 4 or as in FIG. 5. In FIG. *7a* through *7d* it can be seen that a slide mechanism within a guiding channel and to which a stay is pivotally mounted provides the desired friction. The arrangement as shown in FIGS. *7a* through *7d* shows in any direction a window or the equivalent member 30 pivoted at 31 to an arm 32 while arm 33 is pivoted at 34 to a member 35 constrained to slide reproducibly (but preferably with some frictional constraint) along the guiding channel or the equivalent 36. The ends of the arms 33 and 32 pivoted respectively at 37 and 38 to the window frame 39 interengage (this is shown by drawing convention) in the way as depicted in FIG. 6.

Between the closed condition as shown in FIG. *7a* (FIG. 6 as 77 & 78) to the opened condition of FIG. *7d* (FIG. 6 as 4 & 5) the disposition of the arms and the sliding pivot point 34 is shown, the movement of one arm, eg. 32 controlling the movement of the other arm 33 by the inter-connection.

FIGS. *8a* to *8d* detail one way in which a guide can be provided for the friction slide shown in FIGS. *7a* to *7d*. FIGS. *8a* to *8d* show a form the member 35 and guiding track 36 can take to provide for the movement of the moveable pivot 34. In FIG. 8 there is shown a block or other member 40 (eg. of NYLON or aluminium) which provides the moving pivot 41 to which an arm such as 33 (not shown) is engaged as with the pivot 34 and member 35 shown in FIG. *7c*. In FIGS. *8a* through *8d* however, the equivalent to the track 36 is defined by an extrusion 42 of the configuration showing in FIG. *8a*.

Figure 8A:
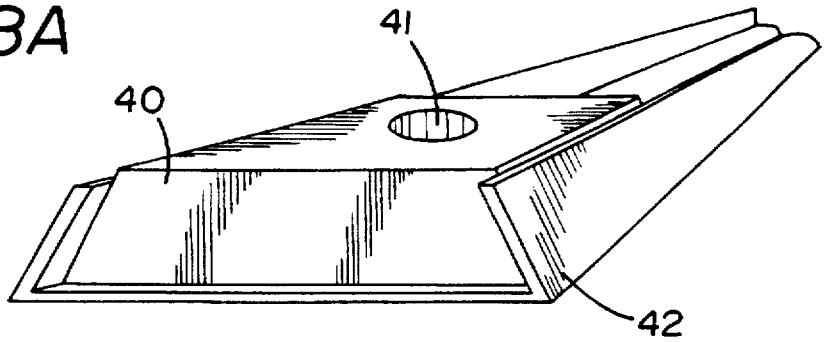
FIGS. 8*a* to 8*d* detail one way in which a guide can be provided for the friction slide shown in FIGS. 7*a* to 7*d;*
Figure 8B:
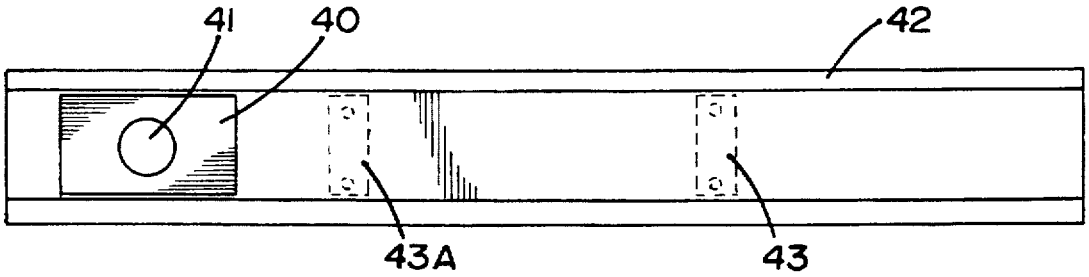
Figure 8C:
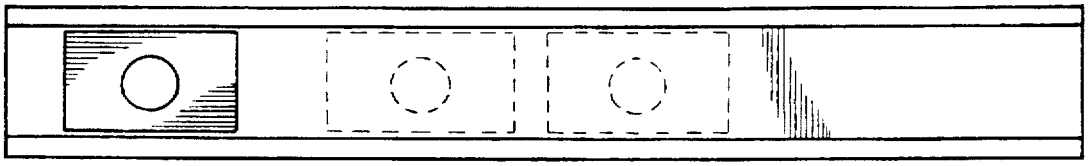
Figure 8D:
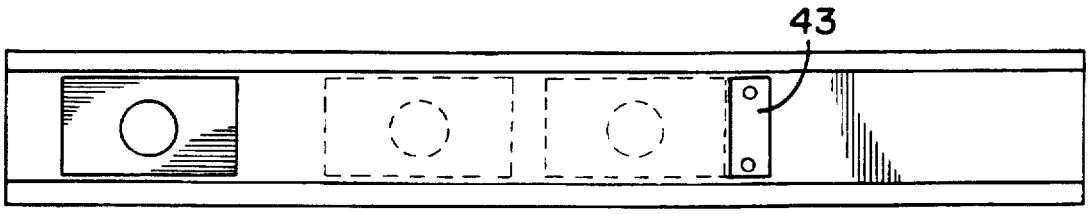

As can be seen the member 40 can move as shown in FIGS. 8*b* through 8*d* through a number of different conditions with, if desired, a stop for any sliding movement being provided by the abutment stop member 43 or 43*a* shown mounted (in broken outline) in a number of positions (eg. by screws or pop rivets).

The materials from which the various components are manufactured is not critical provided they serve the appropriate function. For example, the arms are preferably of a metal, for example, a steel, brass or aluminium while the frames (sash and/or window frame) may be of wood, a metal such as aluminium or steel or even plastics. Any of the members may be composite or coated.

Any appropriate material may be used by the pivots. Preferably with a view to minimising wear and exposure to the elements, the block 35 or 40 can if desired be a non-metal component, such as for example a NYLON block, confined within the channel defining extrusion 42 which can be manufactured from a like material to that of the arms.

Figure 7D:
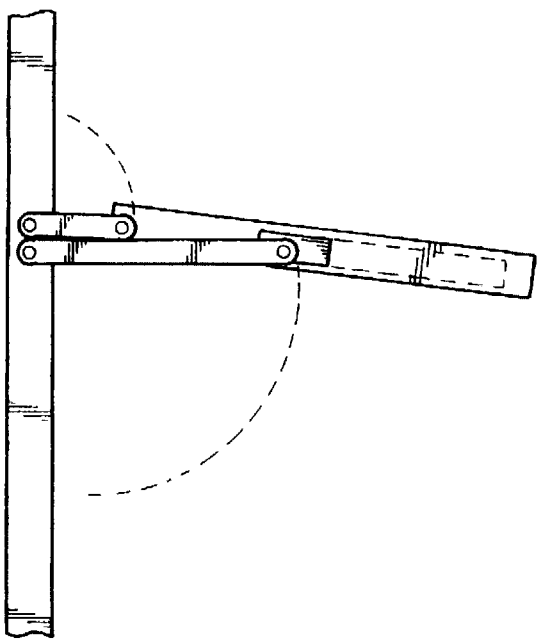
FIGS. 7*a* through 7*d* shows a variation of the form of window stay shown in FIGS. 1 and 2 but when mounted in a configuration either as shown in FIG. 4 or as in FIG. 5.
Figure 7C:
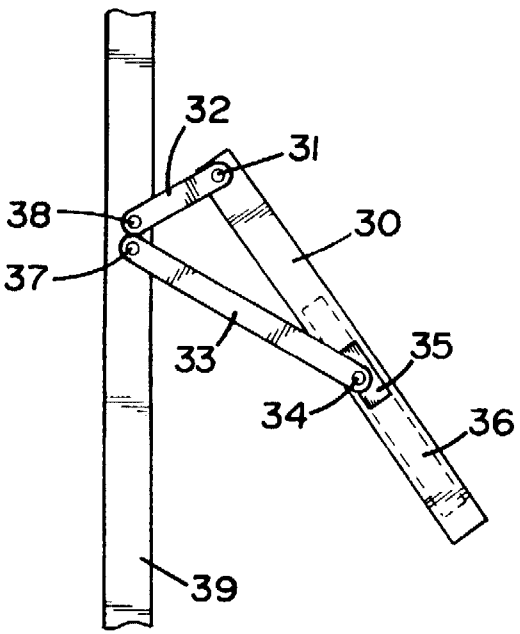
Figure 7B:
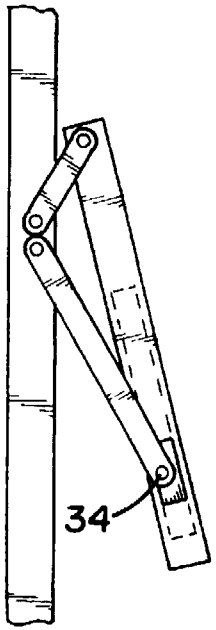
Figure 7A:
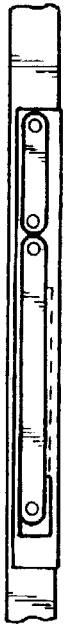
Figures 9A, 9B:
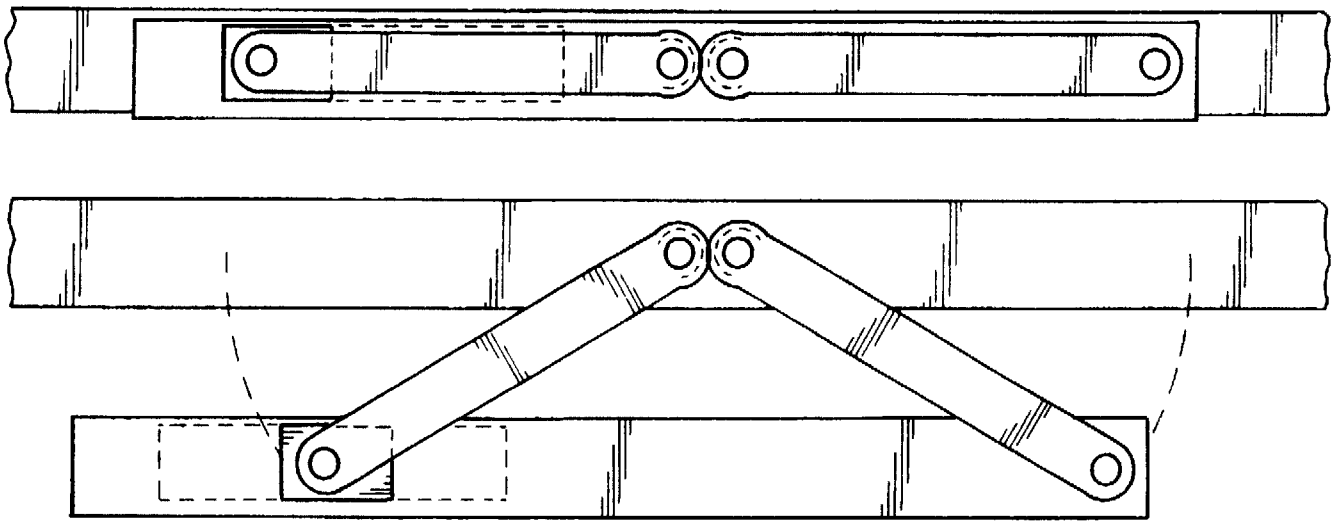
FIGS. 9*a* and 9*b* are alternatives to the arrangement shown in FIGS. 7*a* and 7*b* showing arms of substantial equal length.

FIGS. 9*a* and 9*b* are alternatives to the arrangement shown in FIGS. 7*a* and 7*b* showing arms of substantial equal length. FIGS. 9*a* and 9*b* show an arrangement where arms of a similar length are used, meaning that the opening is in a parallel mode between the closed condition of FIG. 9*a* and an open condition as depicted in 9*b*. This can be desired for security purposes to restrict access through an opening or to minimise exposure to weather. Persons skilled in the art therefore will appreciate that between the conditions shown for example in FIGS. 9*a* and 9*b* and those depicted in, for example, 10*a* and 10*b*, it is possible to vary the angular disposition of the opened member relative to the sash.

Figure 10A:
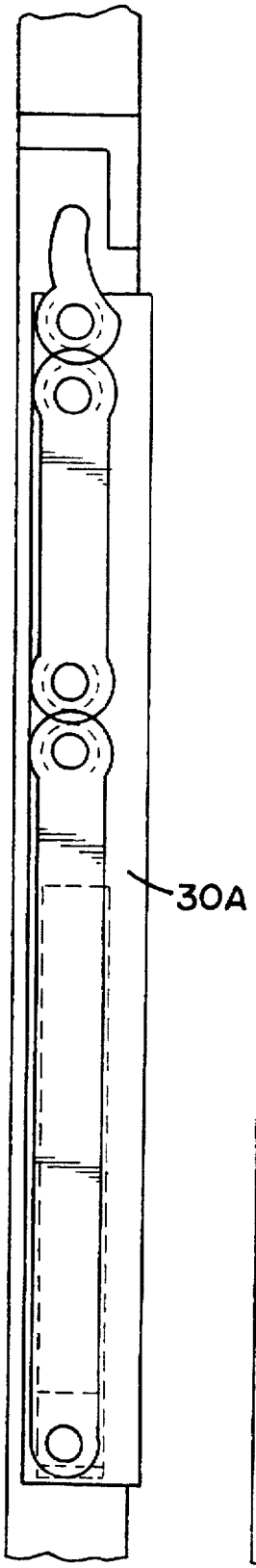
FIGS. 10*a* and 10*b* are still other alternatives to FIGS. 7*a* and 7*b* and in this particular form one of the arm lengths operates by way of a gear interaction with a member capable of providing, better security against opening.
Figure 10B:
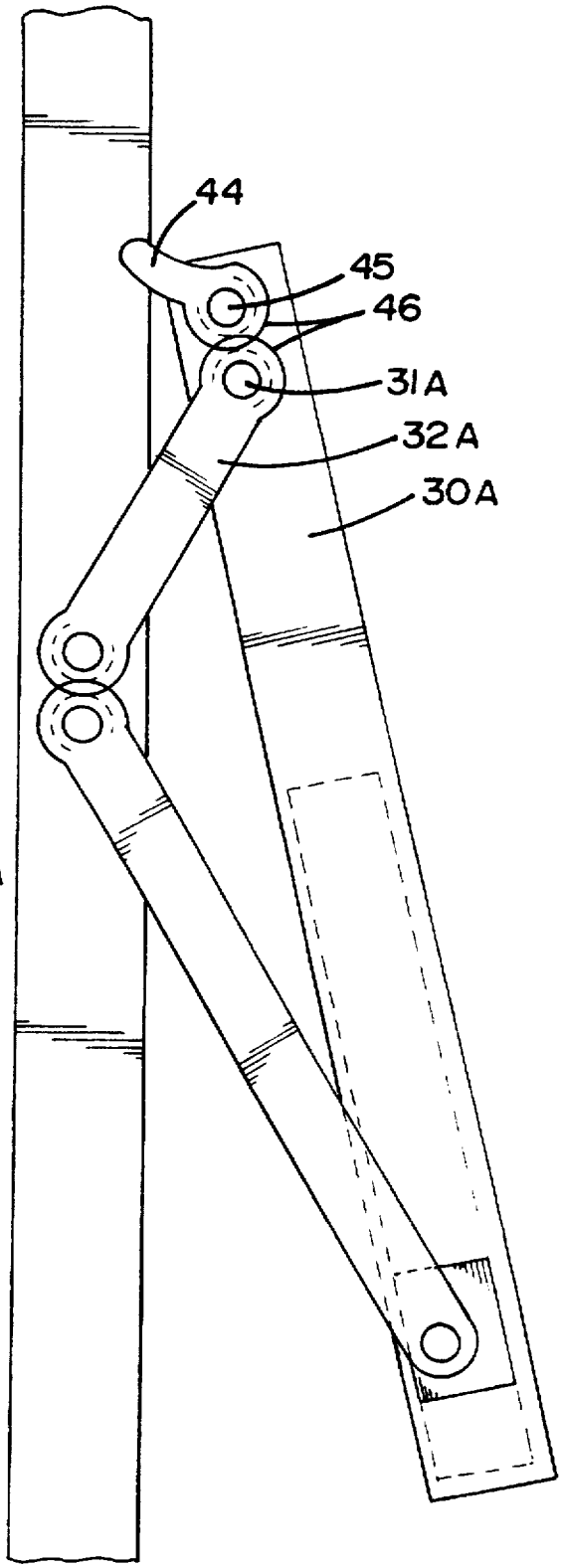

FIGS. 10*a* and 10*b* are still other alternatives to FIGS. 7*a* and 7*b* and in this particular form one of the arm lengths operates by way of a gear interaction with a member capable of providing, better security against unauthorised opening. In the form as shown in FIGS. 10*a* and 10*b*, the arrangement is much the same as shown in FIGS. 7*a* through 7*d* save for the provision in conjunction with the pivot 31*a* of the arm 32*a* of an intermeshing weather seal member 44 pivoted at 45 to the window frame 30*a*. Intermeshing teeth (not shown) preferably are provided at 46 on both members 32*a* and 44.

FIG. 10*a* shows how the weather seal can be positioned so as to be positioned neatly upon full closure of the window frame 30*a* as shown in FIG. 10*a*

Figure 11C:
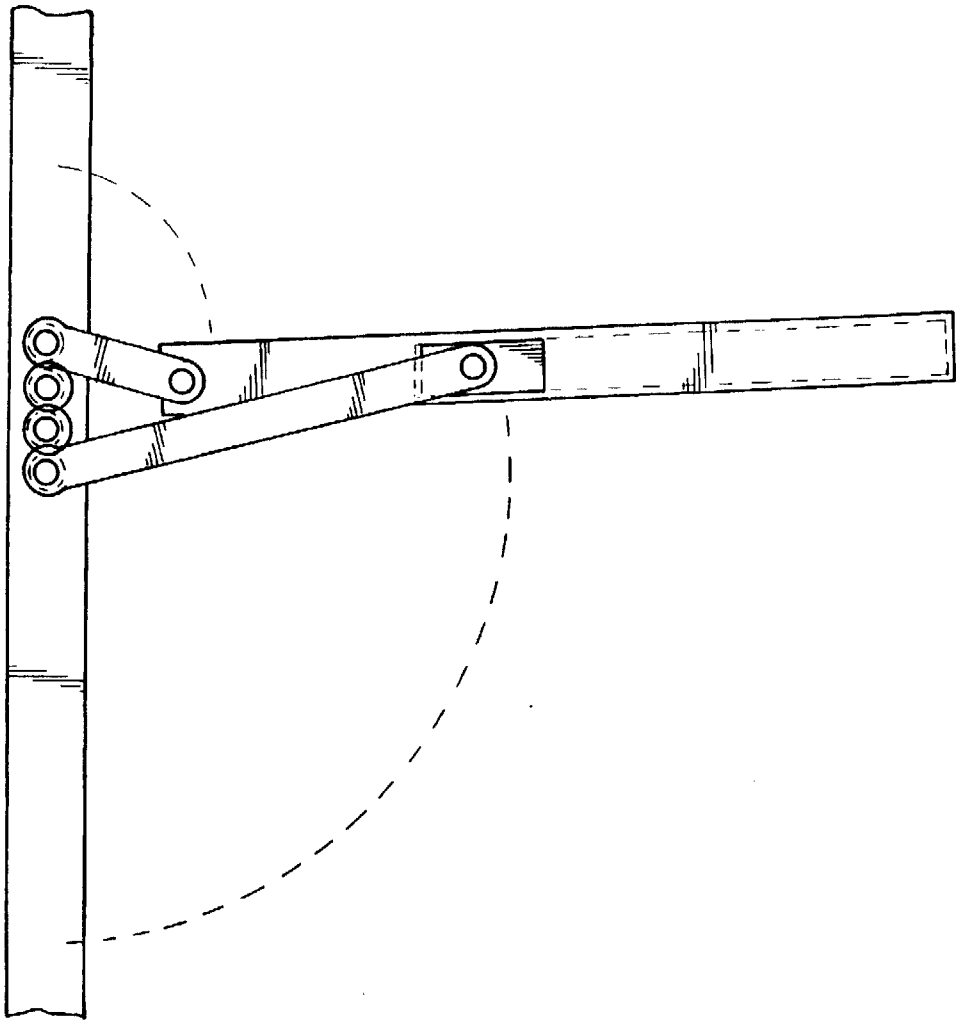
FIGS. 11*a* to 11*c* shows an alternative to the arrangement having the inter engagement depicted previously such as shown in FIG. 6, i.e. it is possible for the rotational axes of the gear toothed ends of the stays 4 and 5 by the provision, not of a greater diameter of the gear inter engaging surfaces but by the provision therebetween of spacing gears capable of being rotated during the requisite period.
Figure 11B:
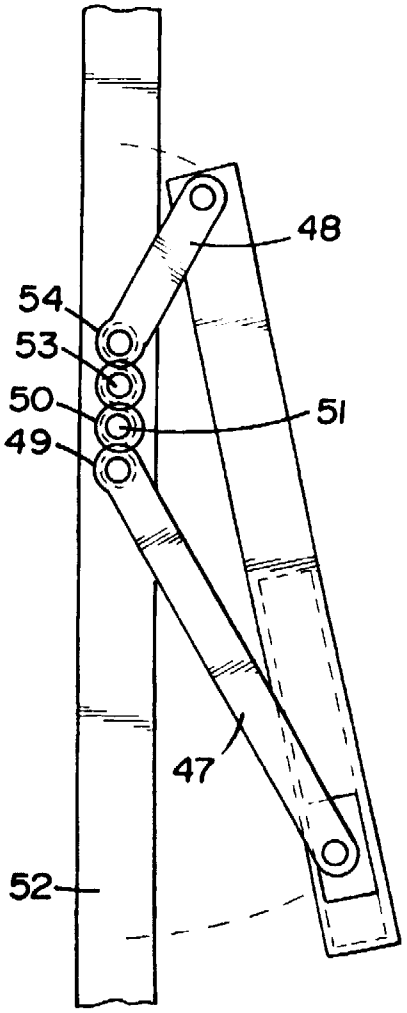
Figure 11A:
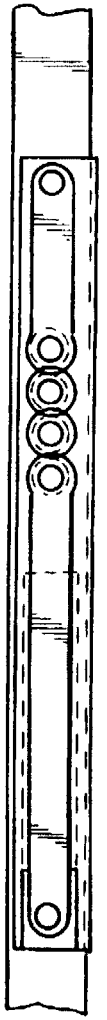

FIGS. 11*a* to 11*c* shows an alternative to the arrangement having the inter engagement depicted previously such as shown in FIG. 6, i.e. it is possible for the rotational axes of the gear toothed ends of the stays 4 and 5 by the provision, not of a greater diameter of the gear inter engaging surfaces, but by the provision therebetween of spacing gears capable of being rotated during the requisite period. In this particular form the arms 47 and 48 operate in the same manner as previously described with, for example, reference to FIGS. 7*a* through 7*d* but the intermesh of the teeth such as shown in FIG. 6 is not direct. Rather the teeth 49 of member 47 mesh with teeth shown diagrammatically as 50 of another member pivoted at 51 to the frame 52. One such member can be interposed between the arms 47 and 48 in an intermeshing relationship, but as shown in FIGS. 11*a* through 11*c*, the number of such intermeshing members is not critical although even or odd numbers affect direction. In this form a further member pivoted at 53 is shown meshing with the teeth 54 of the arm 48 as well as the teeth 50 which in turn mesh with the teeth 49.

Figures 12A, 12B, 12C:
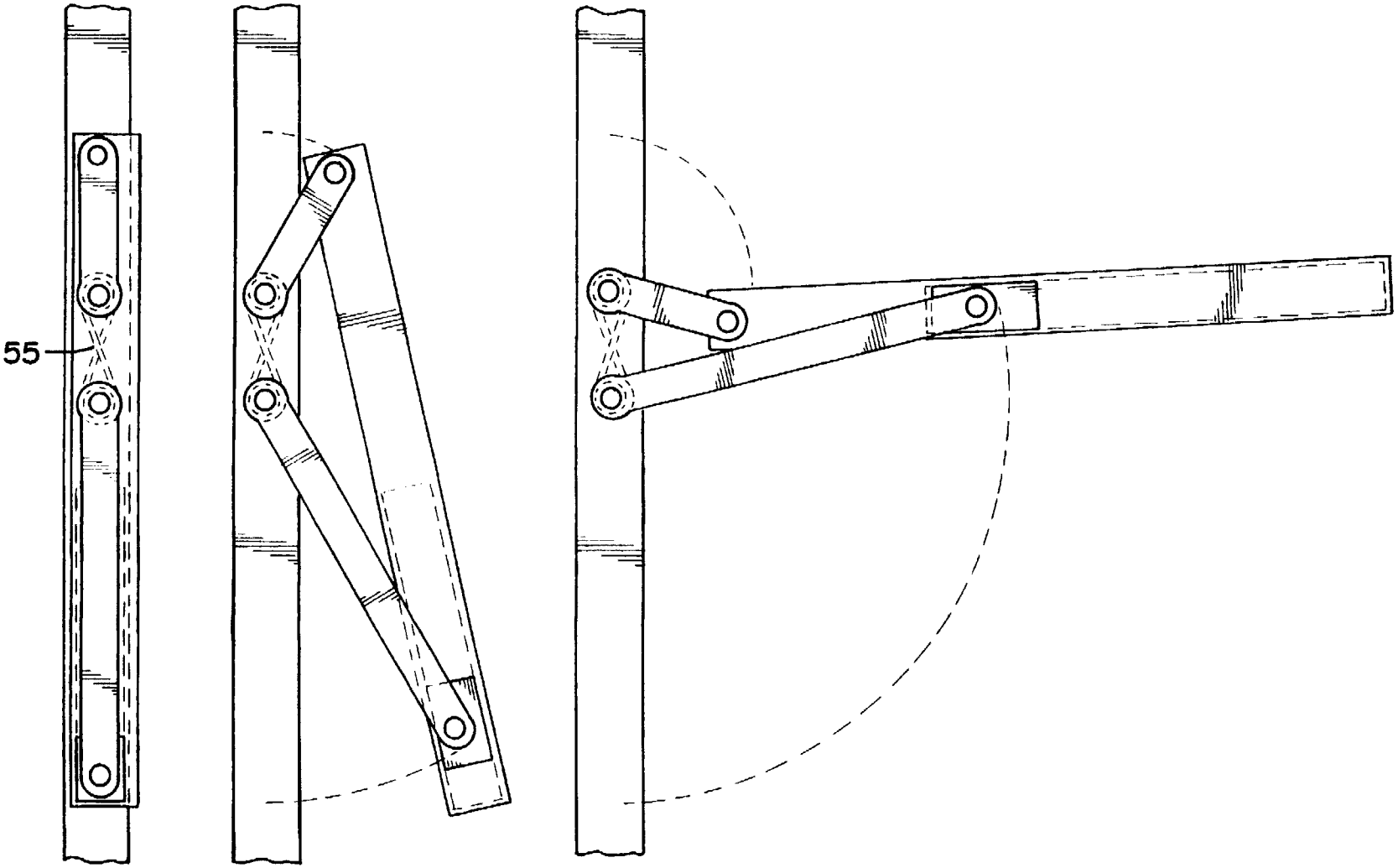
FIGS. 12*a* through 12*d* and 13*a*–13*c* show an alternative to the arrangement shown in FIG. 3, and this arrangement there is a FIG. 8 belt or chain providing for the movements as depicted through 12*a* to 12*c*. This of course is an alternative to that form shown in FIG. 3 which is shown in greater detail in FIGS. 13*a* through 13*c* which correspond drawing for drawing to the alternative of FIGS. 12*a* to 12*c;*
Figure 12D:
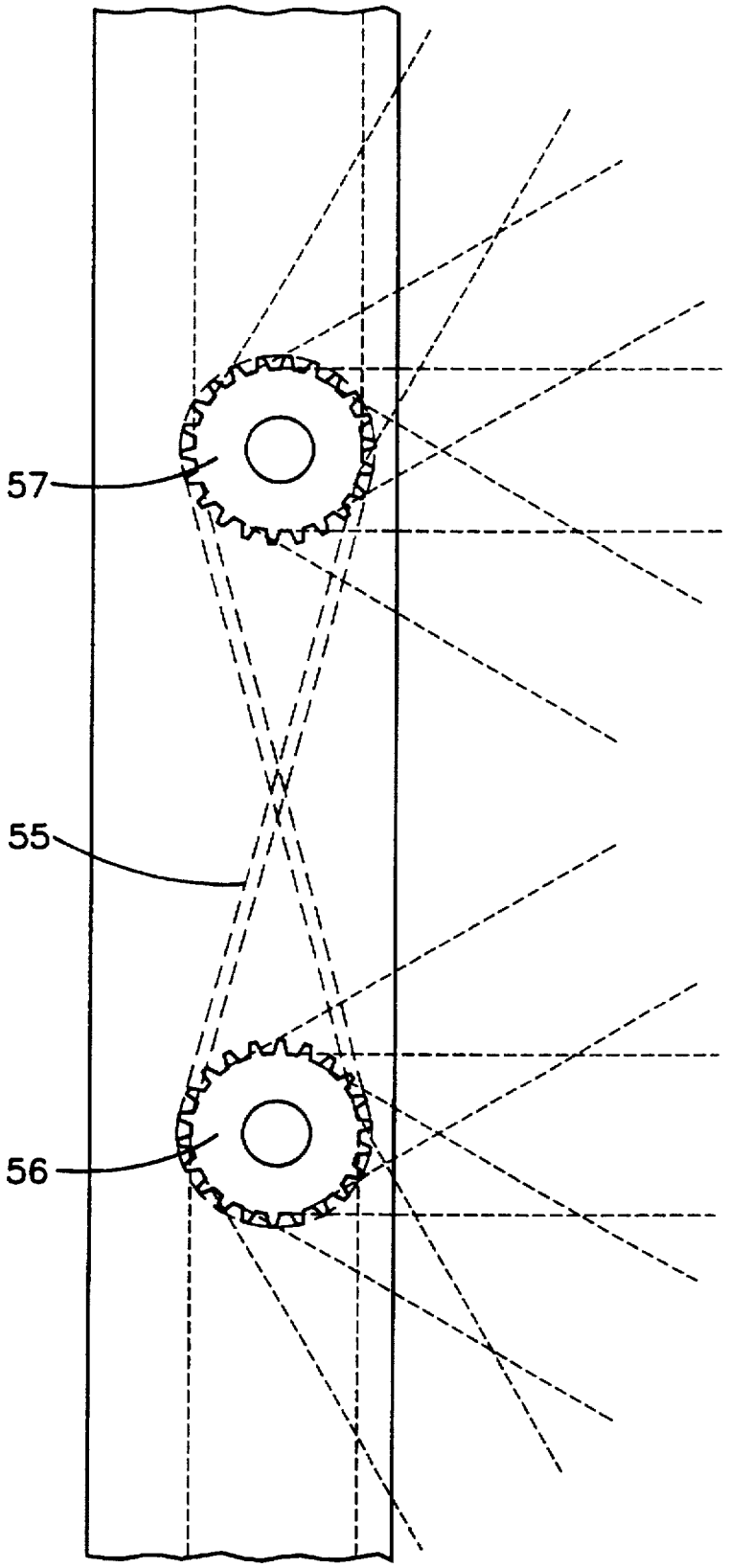

FIGS. 12*a* through 12*d* show an alternative to the arrangement shown in FIG. 3. In this arrangement there is a FIG. 8 belt, cable or chain providing for the movements as depicted through 12*a* to 12*c*. This of course is an alternative to that form shown in FIG. 3 which is shown in greater detail in FIGS. 13*a* through 13*c* (which correspond drawing for drawing to the alternative of FIGS. 12*a* to 12*c*). FIG. 12*a* through 12*c* shows how if desired the arms can be interconnected otherwise than by a direct intermeshing. In this particular form there is shown a FIG. 8 arrangement whereby a chain, belt or other flexible member provides the interconnection between appropriate sprockets, pulleys or the like. Preferably the arrangement uses a chain 55 best seen in FIG. 12*d* engaged with sprocket members 56 and 57 of arms shown in a number of different positions in broken outline.

Still another embodiment is that using a rack and pinion shown in FIGS. 14*a* through 14*d*. In this arrangement the window frame for the equivalent 58 has the arms 59 and 60 differently arrayed but still interconnected, in this particular form, as previously shown as being interconnected by way of an endless chain 61 (FIG. 13A). The array is different however in that arm 59 projects to one side of the plane of the sash 58 while the arm 60 projects to the other side of the plane thus giving rise to the arcuate movements shown in broken outline in FIG. 13*b*.

Figure 13B:
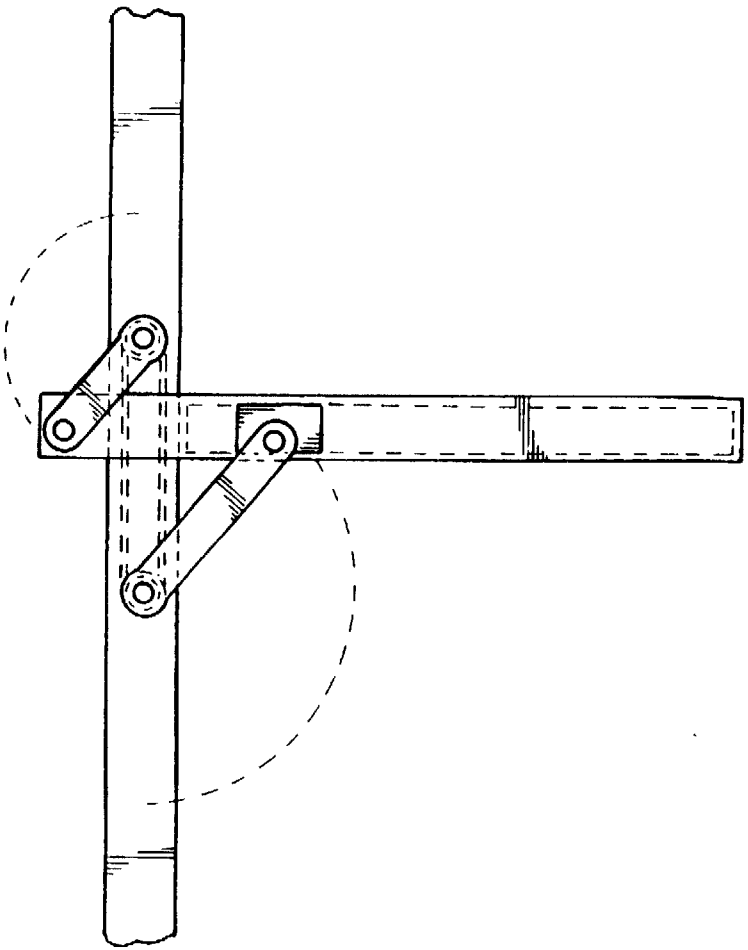
Figure 13A:
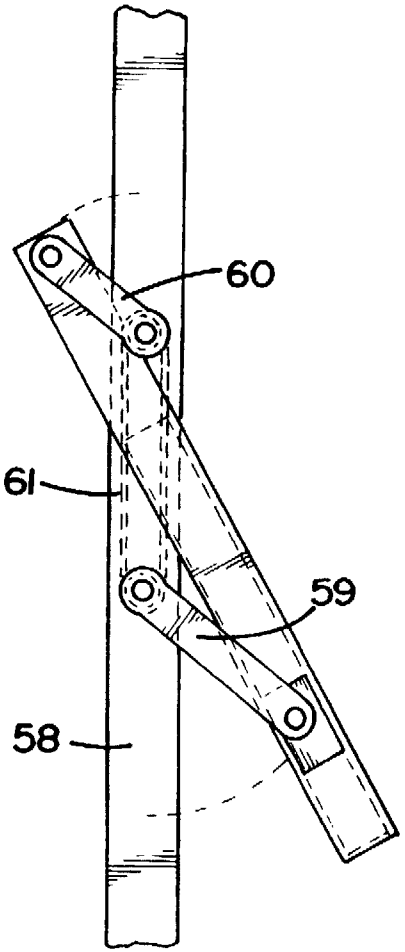
Figure 13C:
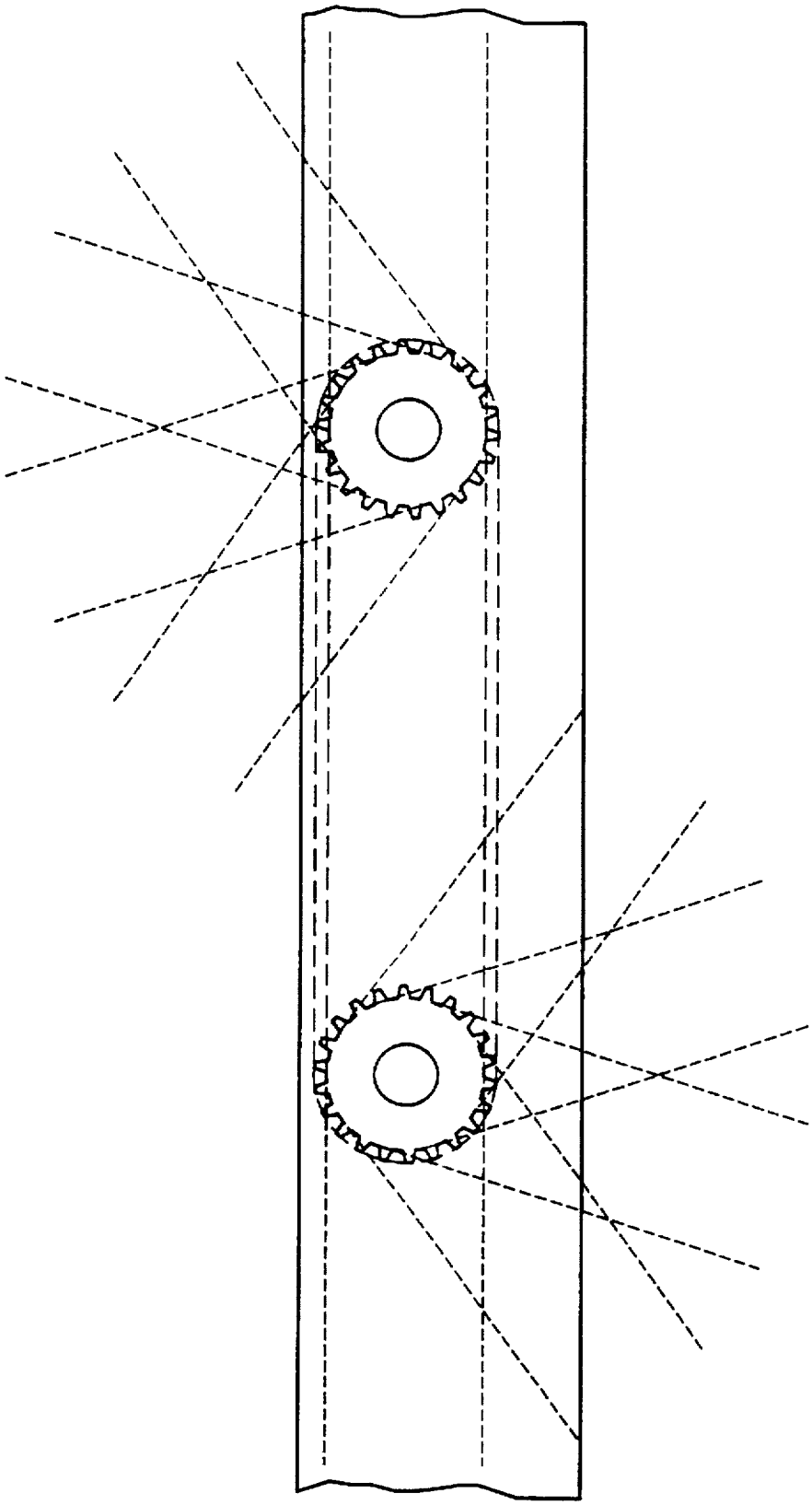
Figure 14B:
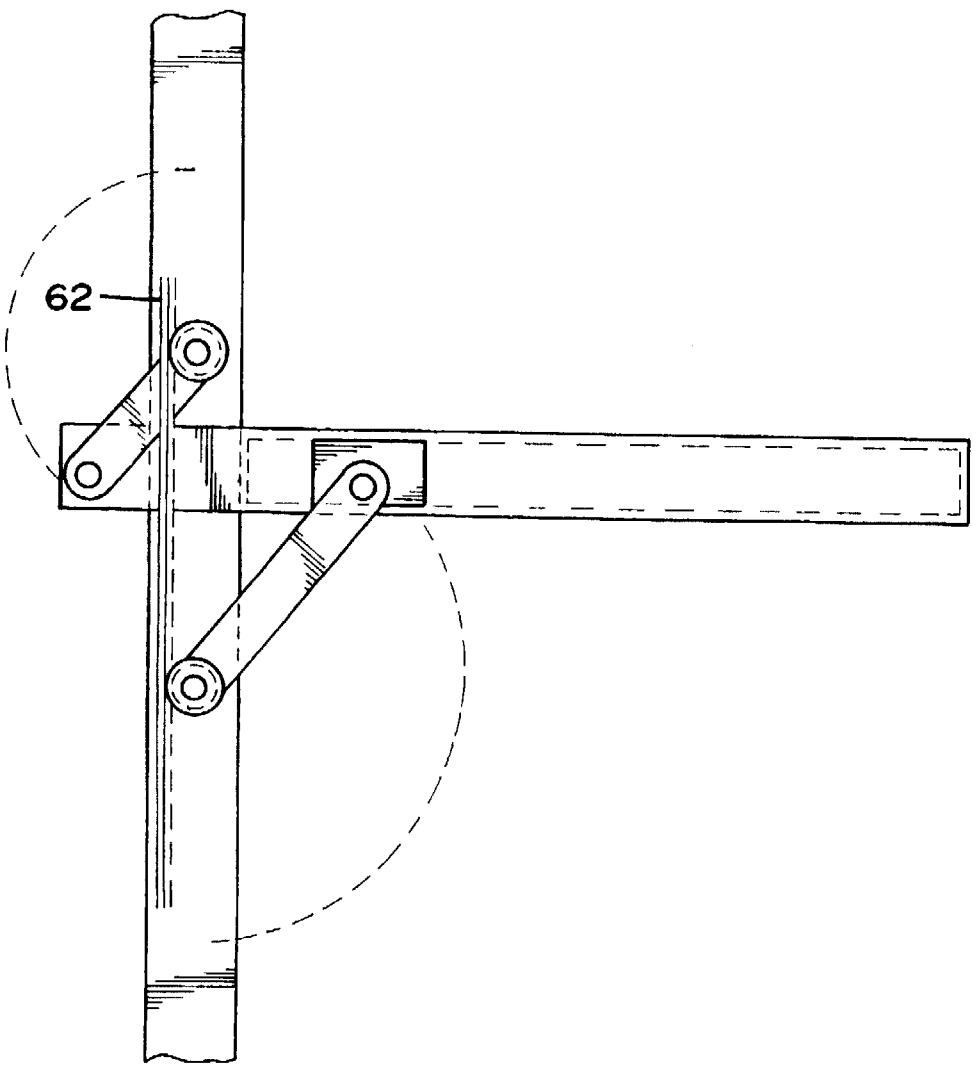
FIGS. 14*a* through 14*d* detail a rack and pinion interconnection.
Figure 14A:
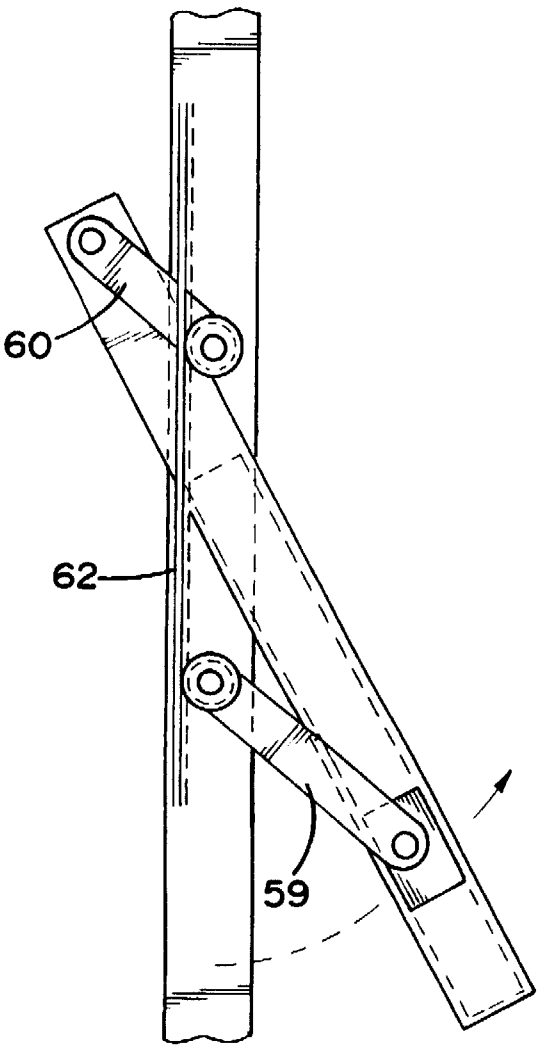
Figure 14C:
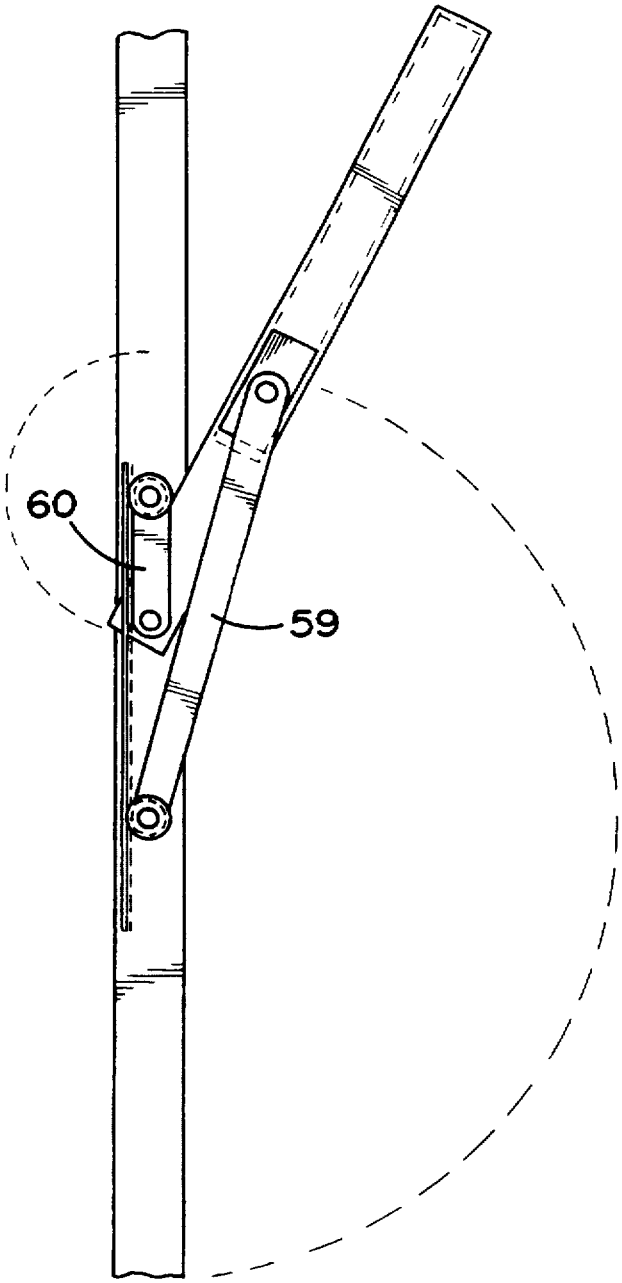
Figure 14D:
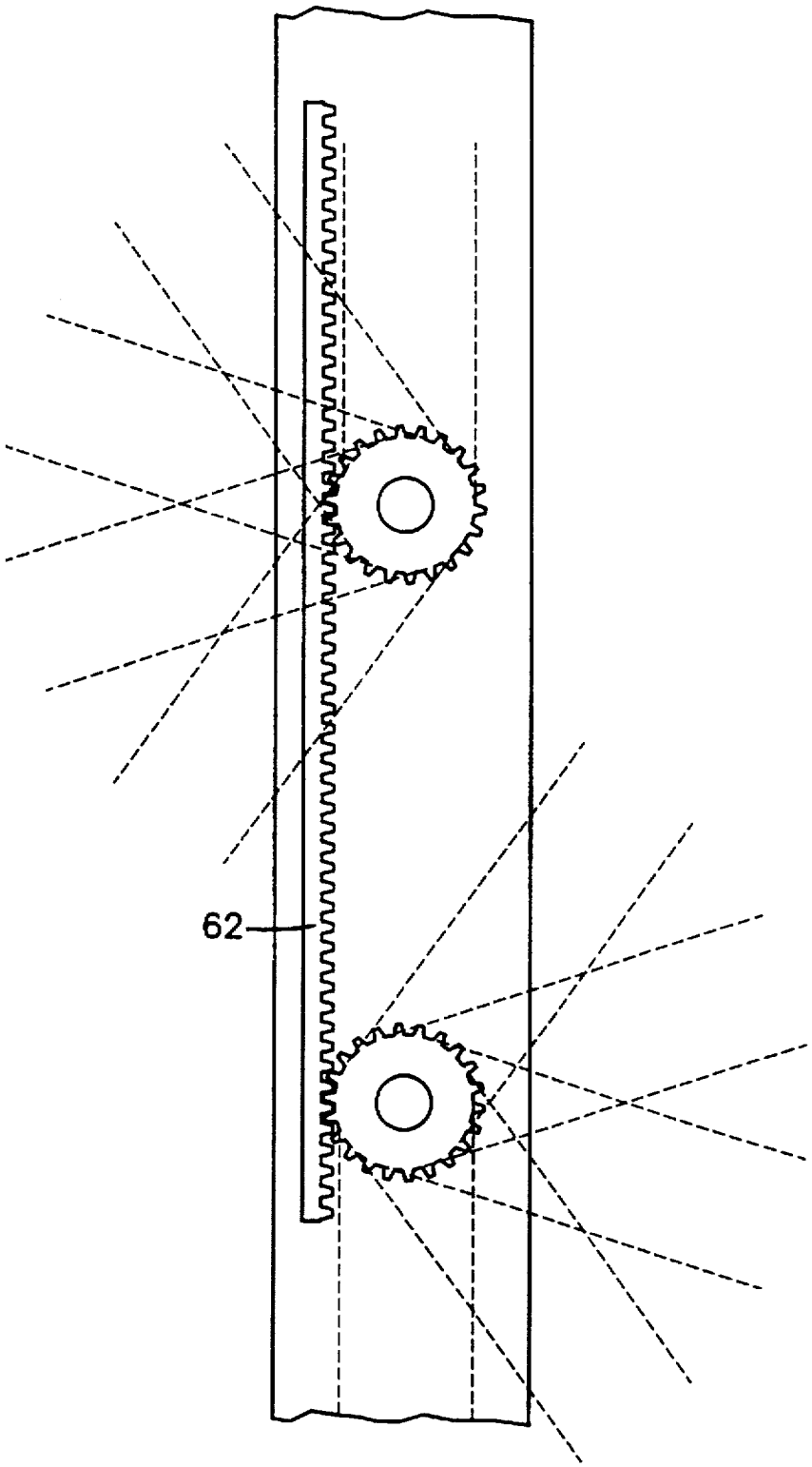

FIGS. 14*a* through 14*c* is a similar arrangement to that of FIGS. 13*a* and 13*b* but showing rather than the use of an endless chain 61 engaged with sprockets (not referenced in FIGS. 13*a* and 13*b*), the use of a rack 62 with which the teeth of the toothed ends of the arms 59 and 60 can engage. FIG. 14*c* shows the large degree of opening permitted by such spaced but interconnected (mechanically) a pair of arms 59 and 60.

Such a straight racked rack and pinion mechanism can alternatively be formed in the different configuration shown in drawings 15*a* through 15*c* where the rack has its teeth elements split into two parts, each oppositely directed to act on a pinion/gear in much in the same way as would occur with the FIG. 8 type arrangement previously described.

Figure 15B:
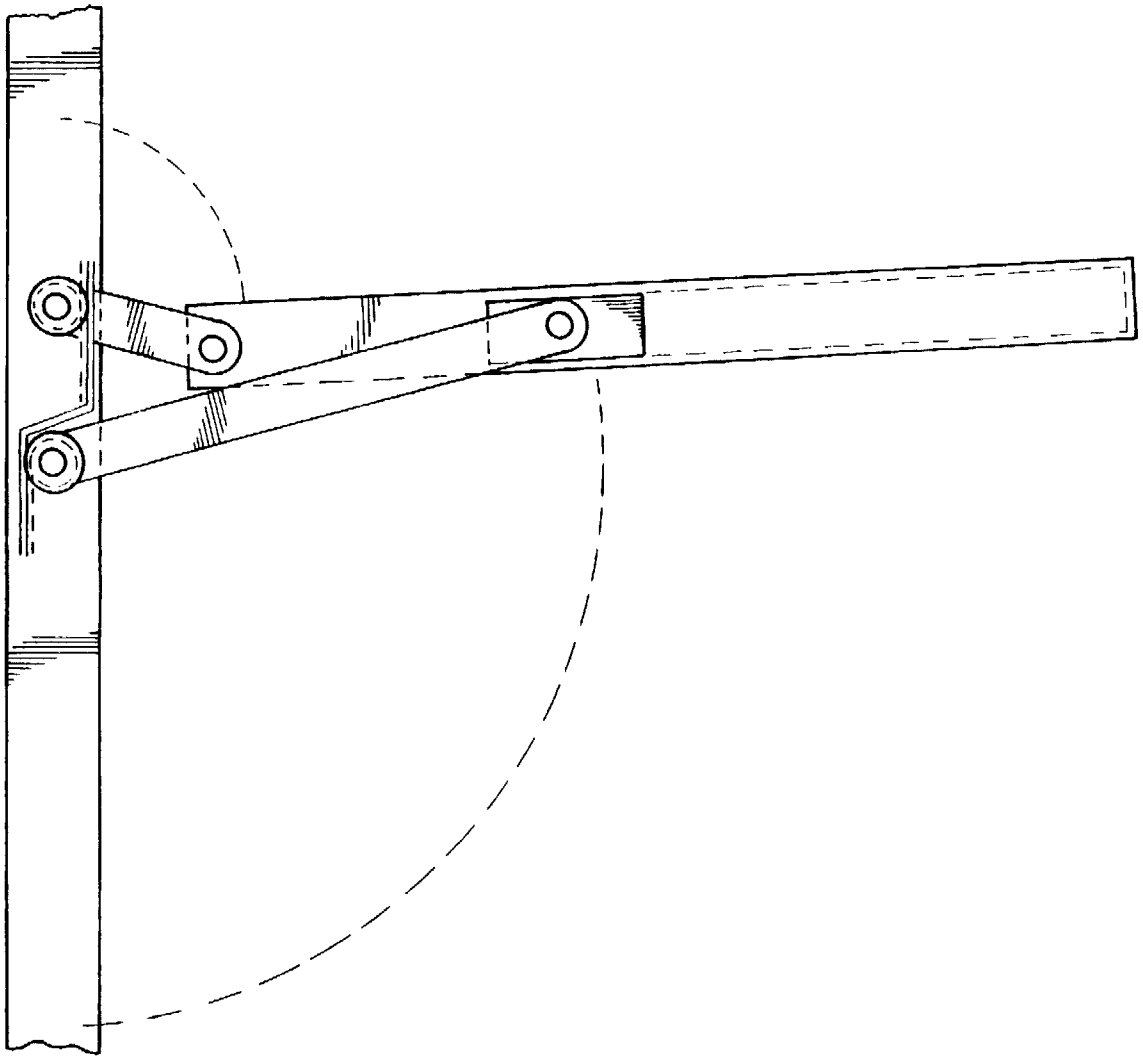
FIGS. 15*a* through 15*c* detail an embodiment where the rack has its teeth elements split into two parts, each oppositely directed to act on a pinion/gear much in the same way as would occur with the FIG. 8 type arrangement previously described.
Figure 15A:
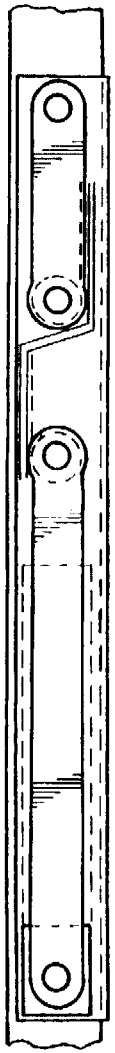
Figure 15C:
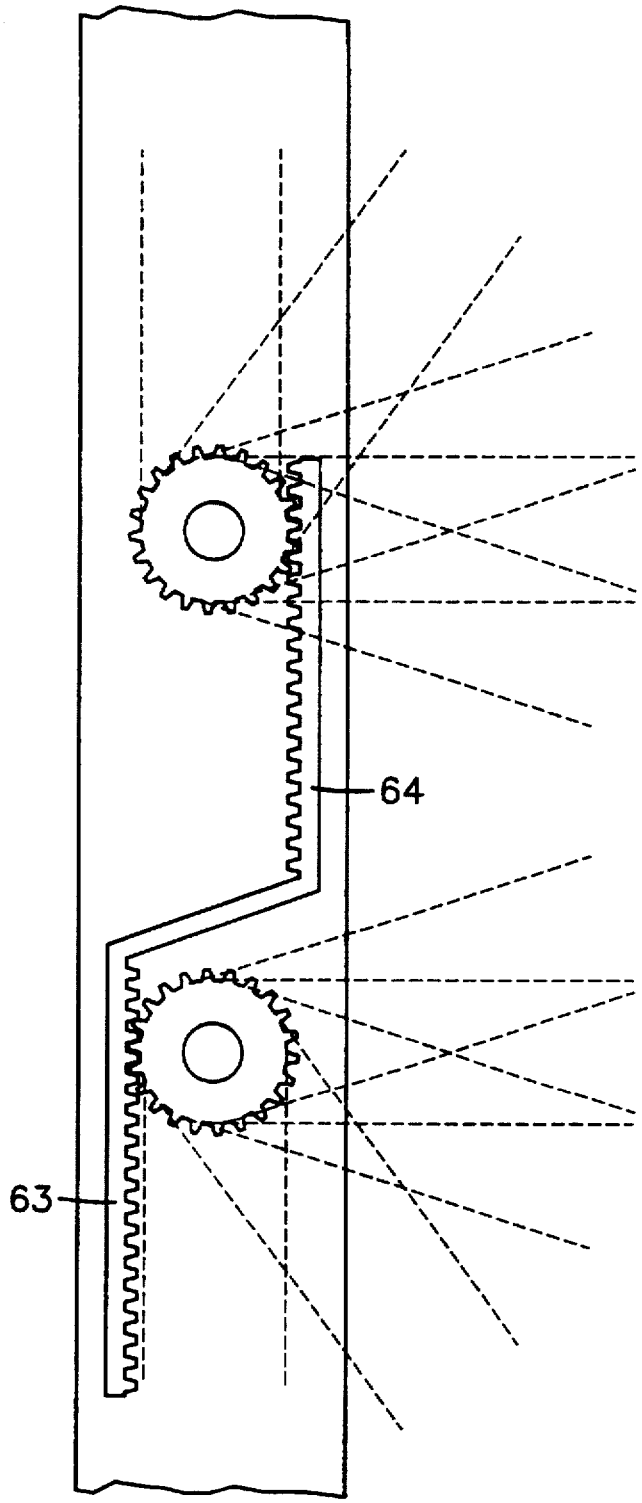

In FIGS. 15*a* through 15*b* the stepped or complex rack is depicted as 63 and 64. Other rack forms including arcuate are possible.

Figures 16A, 16B:
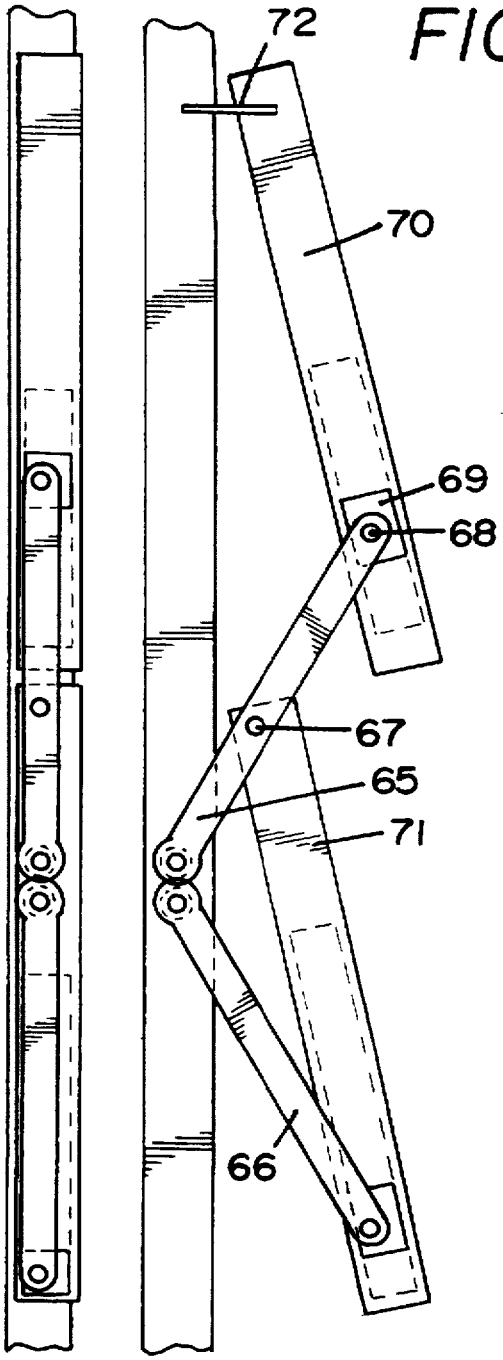
FIGS. 16*a* and FIG. 16*b* show a variation of the arrangements previously depicted where a stay arm for one window is extended to a slide member within a guide on another window, the arrangements being moveable between the conditions of FIGS. 16*a* and 16*b* at least.

FIG. 16*a* and FIG. 16*b* shows a variation of the arrangements previously depicted where a stay arm for one sash is extended to a slide member within a guide on another sash, the arrangements being moveable between the conditions of FIGS. 16*a* and 16*b* at least.

FIG. 16*b* shows how if desired an arm 65 that is interengaged with an arm 66, much in the way as described earlier in relation to, for example, FIG. 1 or FIG. 2, can have arm 65 (while pivoted at 67) extend to a sliding pivot 68 of a guidably slidable block member 69 on a related window sash 70 to that of 71. With such a separate but interconnected window sash 70 a simple pivot at the top of the window may be all that is required. However if desired a slide or other mounting 72 that provides a degree of play can be used so that the closed condition as shown in FIG. 16*a* can be assumed.

Figure 17:
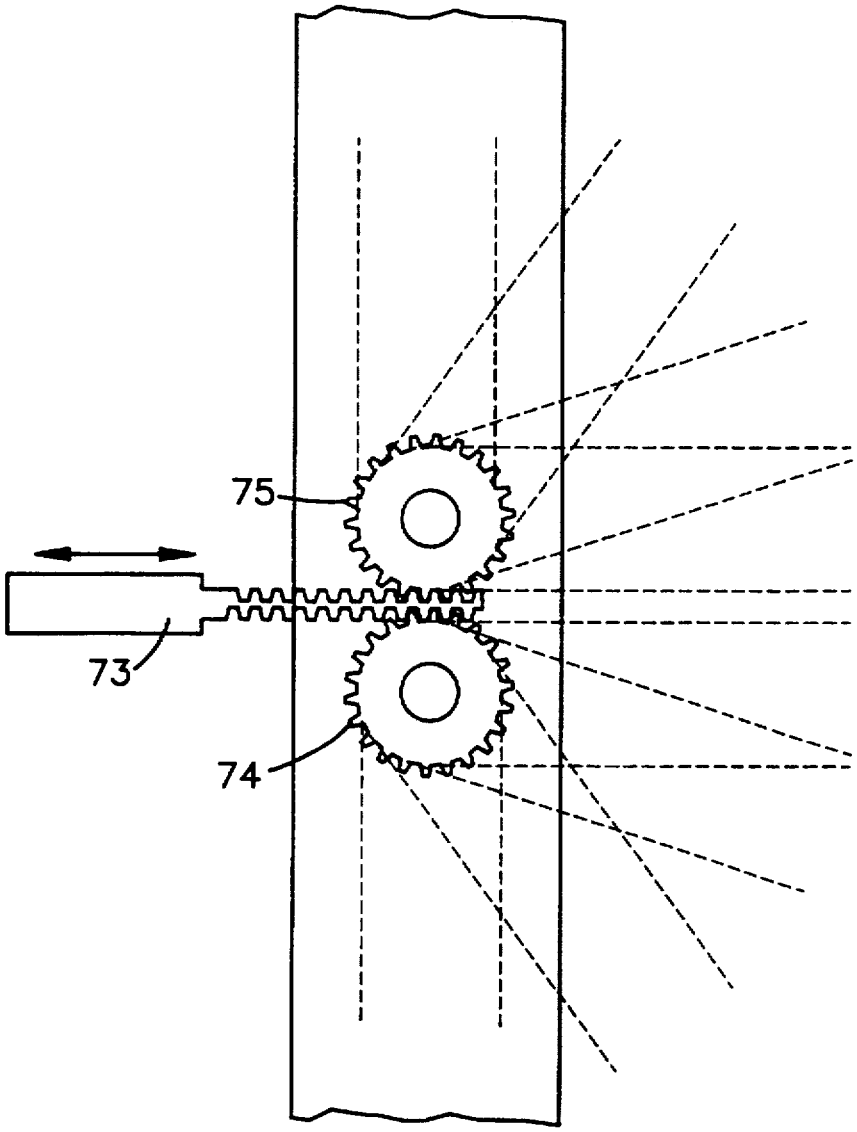
FIG. 17 shows an arrangement whereby a push/pull reciprocal member interacts between the gear teeth ends of the window stays and thus provides a means of actuation and provides friction.

FIG. 17 shows an arrangement whereby a push/pull reciprocal member interacts between the gear teeth ends of the window stays and thus provides a means of actuation and/or to provide friction between the still interconnected arms. In FIG. 17 the actuator 73 moves to open or close, or at least to allow such opening and closing the window. Therefore the gear ends or sprockets or the equivalent 74 and 75 of the two arms necessarily will move as appropriate member 73 inwardly or outwardly between the teeth 74 and 75. This "cause and effect" relationship means that the member 73 can be used to open or close the windows or to provide any appropriate degree of friction in between the members 74 and 75.

Figure 18:
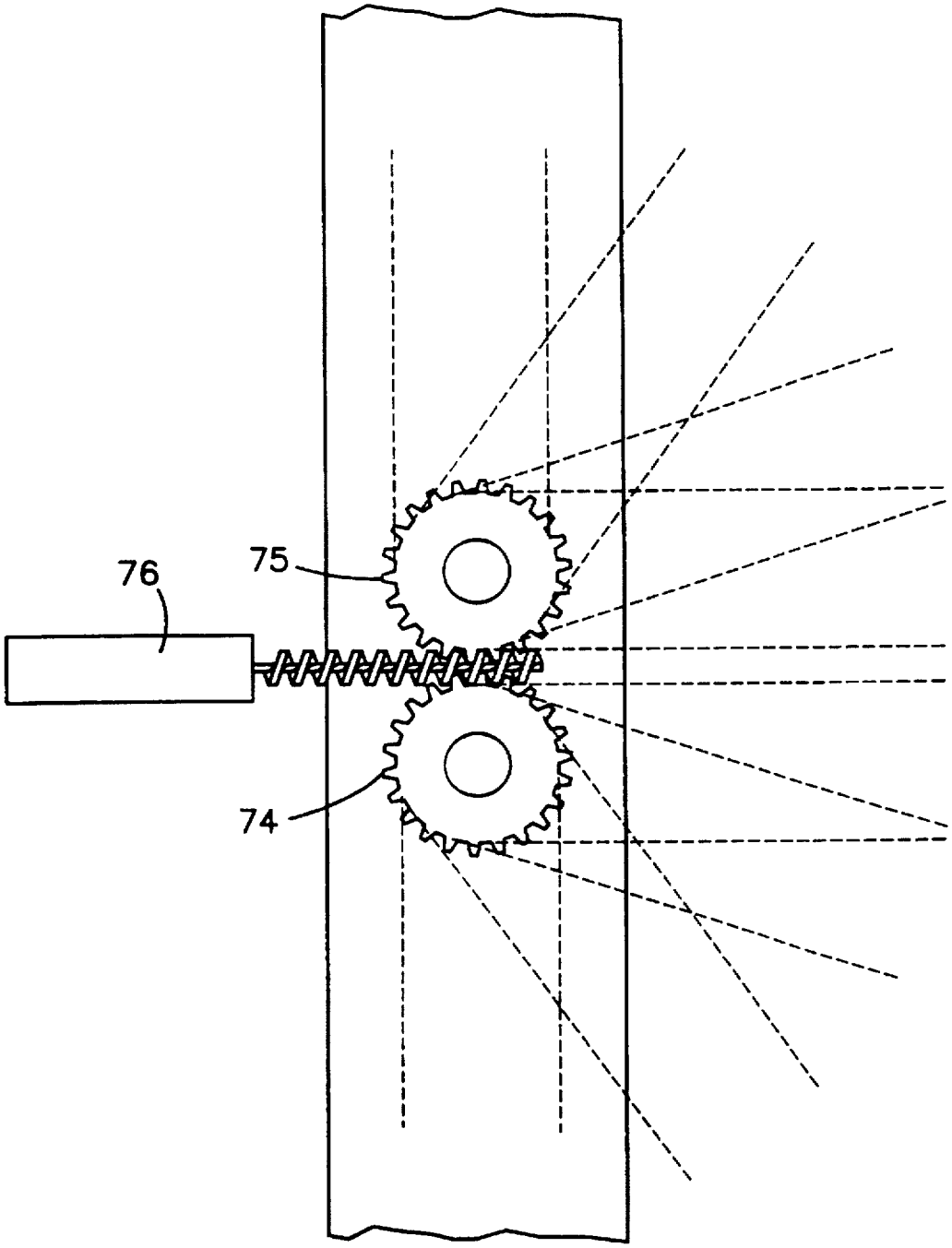
FIG. 18 is a rotational threaded arrangement as an alternative to that of FIG. 17.
Figure 23:
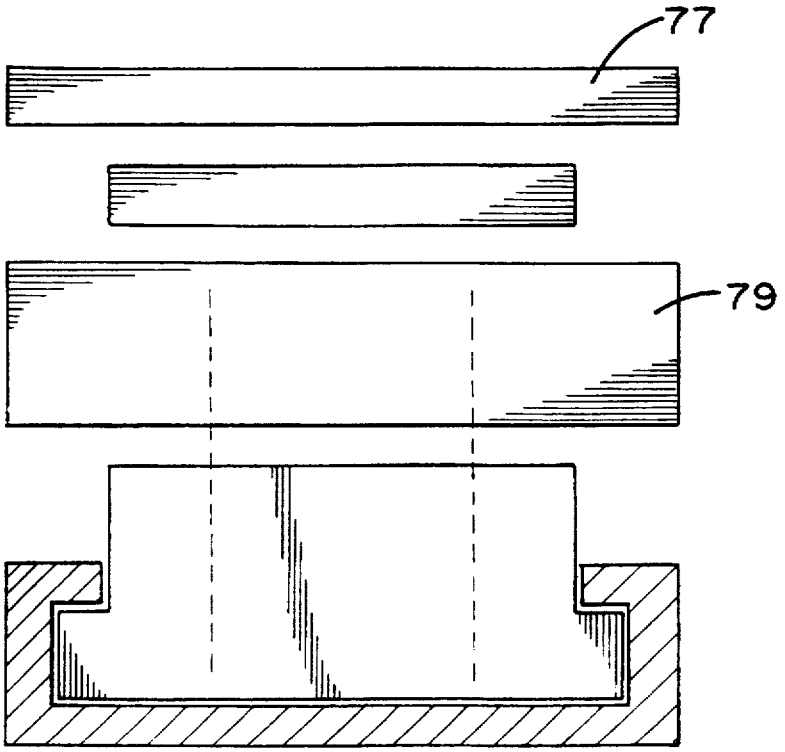
FIG. 23 is a diagrammatic sectional view at the line AA with respect to FIG. 21 showing how the sliding pivot of one of the stays can be depicted.

An alternative to the push/pull arrangement of FIG. 17 is the rotational threaded arrangement of FIG. 18. In this particular arrangement the teeth, the gears or sprockets 74 and 75 are interconnected via a helical thread of an actuator 76. It too has the "cause and effect" relationship but preferably is pitched.

While it can be seen that the actuators or friction providing members 73 and 76 can take a number of different forms it can also be seen that the sliding blocks providing the moving pivot themselves can be arranged so that the friction can be varied, meaning in open and/or closed conditions there is a greater resistance to movement. Indeed the sliding blocks or the like could be provided with adjustable members whereby the degree of friction built into the stay can be varied. Alternatively or as well the friction built into the stay can be varied by use of members such as those referred to as 73 and 76.

In FIGS. 19 through 23 it can seen that a mounting plate 77 has at pivot axes 78 the stays 79 pivoted thereto.

As depicted in FIG. 19 the plate 77 can have mounting abattoirs 80.

A person skilled in the art will appreciate how each and everyone of the earlier disclosed embodiments can have the directly or indirectly interengaged pivoted ends likewise mounted on a mounting plate.

It is believed that window stays or stays for other purposes (but herein throughout referred to as "window stays") in accordance with the present invention provides a number of advantages over many conventional forms of window stay which frequently are restrictive as to the movement possibilities or are too thick and thus provide design problems for an architect wishing to minimise the intrusion of window stays into the window space or to minimise detrimental aesthetics.

The present invention envisages the embodiments as previously set forth as well as other variations thereof falling within the scope of the present invention as defined in the appended claims. The invention also consists in components for such window stays in a kit set or other inter-related form for assembly whether or not coupled with instructions for assembly. The present invention also consists in the use of such window stays as well as window mountings using such stays.

I claim:

1. A window stay assembly comprising first mounting means for mounting the assembly on a window frame, said first mounting means defining two pivot axes extending parallel to and substantially in a plane of a sashed window when said window is closed in said window frame, a first arm pivoted adjacent a toothed end of said first arm to one of said two pivot axes of said first mounting means, a second arm longer than said first arm, pivoted adjacent a toothed end of said second arm to the other of said two pivot axes of said first mounting means, an actuator including teeth, said actuator being interposed between said toothed end adjacent said first arm and said toothed end adjacent said second arm such that the teeth of said actuator intermesh with said toothed end adjacent said first arm and said toothed end adjacent said second arm so that movement of said actuator causes a rotation of one of the first arm and the second arms and a substantially opposite rotation of the other of the first and the second arms, second mounting means for mounting the assembly on a window sash and to which an opposite end of said first arm is pivoted by a pivot axis parallel to the two pivot axes of said first mounting means, said second arm being pivoted to sliding means slidably carried by said second mounting means, the sliding of said sliding means relative to said second mounting means being against a frictional resistance, and said first arm and second arm being operable only by said meshing with said actuator and their inter-relationship via (a) said first mounting means and (b) said second mounting means, and wherein a sliding of the pivot has the effect of allowing both of said first and second arms to lie substantially vertically in the plane of the window sash when the sashed window is closed in said window frame while allowing a top of said sashed window, when the window is open, to be closer to the window frame, yet still being spaced therefrom, than a bottom of said window sash, and when the window is open, the window is stabilisable in such a form under the action only of the window stay assembly on one side of the window and by another window stay assembly on the other side of the window.

2. A window stay assembly as claimed in claim 1, wherein the teeth of said actuator engaging with said toothed end adjacent said first arm and teeth of said actuator engaging with said toothed end adjacent said second arm are provided on separate surfaces.

3. A window stay assembly as claimed in claim 2, wherein a pitch of the teeth of said actuator on the separate surfaces are substantially the same.

4. A window stay assembly as claimed in claim 1, wherein the teeth of said actuator are provided by a helical screw thread.

* * * * *